US005450774A

United States Patent [19]

Chang

[11] Patent Number: 5,450,774

[45] Date of Patent: Sep. 19, 1995

[54] HAND TOOL SET

[76] Inventor: Wong-Lien Chang, 2F., No. 23, Alley 32, Lane 222, Hsin I Road, Lu-Chou Hsiang, Taipei Hsien, Taiwan

[21] Appl. No.: 239,623

[22] Filed: May 10, 1994

[30] Foreign Application Priority Data

Sep. 7, 1993 [CN] China ..... 93223846.7

[51] Int. Cl.[6] ..... B25B 22/00

[52] U.S. Cl. ..... 81/440; 81/437; 81/124.4; 81/177.4; 7/168

[58] Field of Search ..... 81/437–440, 81/450, 124.4, 125.1, 177.4, 490, 177.6; 7/168

[56] References Cited

U.S. PATENT DOCUMENTS 2,148,573 2/1939 Mulcay ..... 81/437 X 5,146,815 9/1992 Scott, III ..... 81/490 X

FOREIGN PATENT DOCUMENTS 1361926 4/1964 France ..... 81/437

*Primary Examiner*—D. S. Meislin

*Attorney, Agent, or Firm*—Pro-Techtor International

[57] ABSTRACT

A hand tool set includes an elongated handle having a U-shaped cross section defined by a bottom and two side walls to provide therebetween a hollow space. The handle has two ends each having a pin extending through the side walls thereof for rotatably supporting hand tools in such a way to allow the hand tools to be rotatable between a first position where the hand tools are received within the hollow space and a second position where the working tips of the hand tools are exposed. The bottom has a sloped section formed at each end of the handle to provide a gap between the handle and a work piece worked upon by the hand tool set. Each of the pivot pins has serration formed on an expanded head thereof for engaging one of the side walls to more securely keep the pin and thus the hand tools supported thereby on the hand tool set.

5 Claims, 3 Drawing Sheets

HAND TOOL SET

FIELD OF INVENTION

The invention relates generally to hand tools and in particular to a hand tool set that has a number of different hand tools movably affixed to a handle thereof for easy to use and carry.

DESCRIPTION OF PRIOR ART

Conventionally, hand tools are deposited in a box for carrying. Quite often, the hand tools will be lost one by one and leaving behind an incomplete set of hand tools.

To overcome such a problem, a hand tool set holder was developed which comprises a container-like base inside which a set of hand tools are secured in a movable manner so as to avoid the tools from being lost piece by piece. The base also has a number of different-sized polygon holes formed thereon, functioning as screw sockets of wrenches for loosening and/or tightening polygon-headed bolts or screws.

A disadvantage of such a hand tool set is that the base has a flat bottom which when tightening or loosening screws or bolts by using the polygon holes thereof will interfere the operation and hand-holding so that 360-degree-rotation operation of the hand tool set is very difficult.

It is therefore desirable to provide an improvement of such a hand tool set which overcomes such a deficiency.

OBJECTS AND ADVANTAGES

It is the principal objective of the present invention to provide an improved hand tool set comprising sloped end sections to enhance holding of the hand tool set and to allow it possible to make 360-degree-rotation operation.

It is also an objective of the present invention to provide an improved hand tool set comprising pivot pins rotatably securing hand tools to the base or handle portion of the hand tool set, the pivot pins having serration for more securely keeping the pins and thus the hand tools supported thereby on the hand tool set.

To achieve these objectives, there is provided a hand tool set comprising an elongated handle having a U-shaped cross section defined by a bottom and two side walls to provide therebetween a hollow space. The handle has two ends each having a pin extending through the side walls thereof for rotatably supporting hand tools in such a way to allow the hand tools to be rotatable between a first position where the hand tools are received within the hollow space and a second position where the working tips of the hand tools are exposed. The bottom has a sloped section formed at each end of the handle to provide a gap between the handle and a work piece worked upon by the hand tool set. Each of the pins has serration formed on an expanded head thereof for engaging one of the side walls to more securely keep the pin and thus the hand tools on the handle.

DRAWING FIGURES

Other objectives and advantages of the invention will be apparent from the following description of a preferred embodiment of the present invention taken in connection with the accompanying drawing wherein.

DESCRIPTION-FIG. 1 to 4

Figure 1:
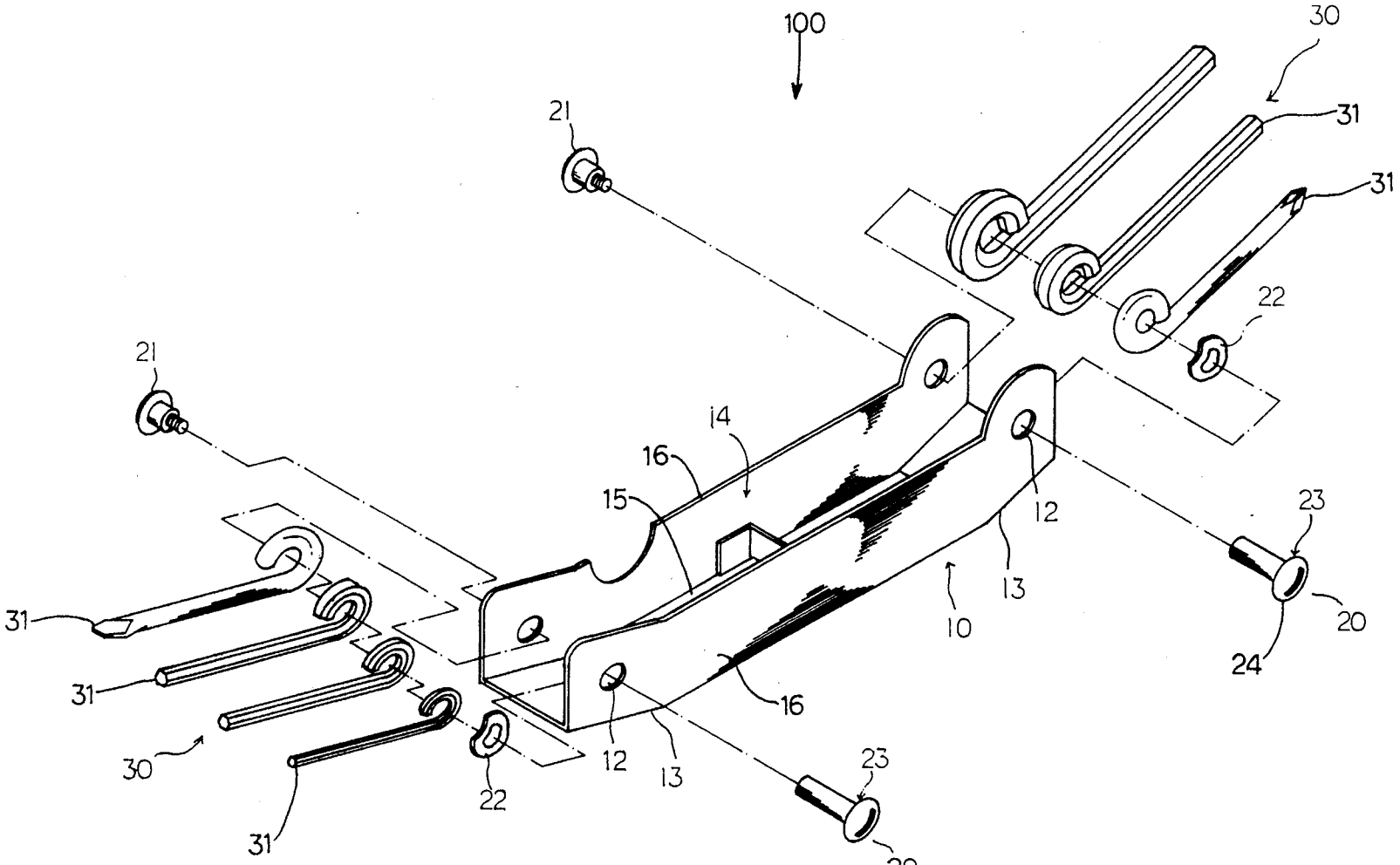
FIG. 1 is an exploded perspective view showing a hand tool set constructed in accordance with the present invention.

With reference to the drawings and in particular to FIG. 1, wherein a hand tool set constructed in accordance with the present invention, generally designated by the reference numeral 100, is shown, the hand tool set 100 comprises a handle 10 in the form of an elongated channel-like bar having a U-shaped cross section comprising a bottom 15 with two side walls 16 perpendicularly mounted thereto to define therebetween a hollow space 14.

Figure 2:
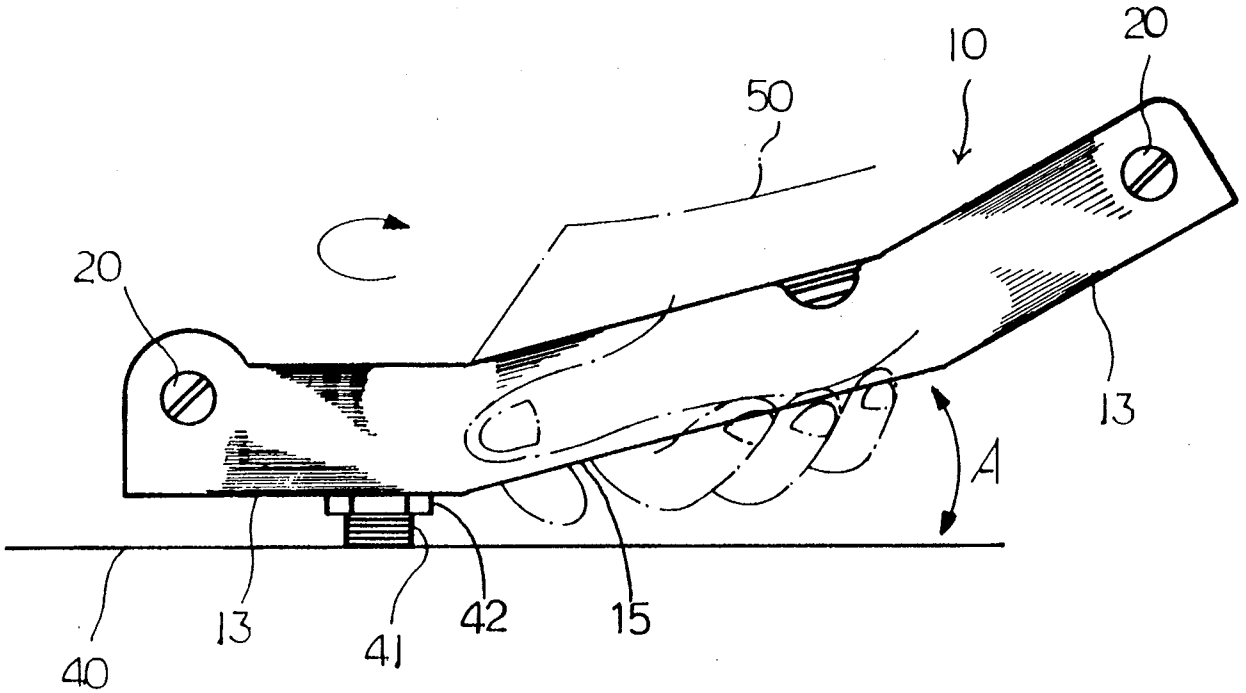
FIG. 2 is an elevational view showing the operation of the hand tool set shown in FIG. 1.

The elongated U-shaped handle 10 has two ends each having a pivot pin 20, preferably with an expanded head 24, such as a bolt, extending through the U shape via, for example two holes 12 respectively formed on the two side walls 16 thereof. A plurality of hand tools 30, each having a working tip formed on an end thereof, are rotatably received, at opposite ends thereof, within the hollow space 14 of the handle 10 with the pivot pin 20 extending therethrough so that the hand tools 30 are rotatable between a first position where they are completely received within the hollow space 14 defined in the handle 10 and a second position where the working tips 31 of the hand tools 30 are exposed to work upon, for example, a work piece 40 (FIG. 2).

In the embodiment shown, there are respectively three and four hand tools 30 secured at each end of the handle 10. However, it is understood that as long as there is sufficient space to receive the hand tools 30, the number of hand tools 30 can be increased as desired.

Preferably, each of the bolts 20 has serration 23 formed thereon, preferably on the expanded head 24 thereof, so that when the bolt 20 is tightened by a nut member 21, the bolt 20 is prevented from being unexpectedly loosened Also, a spring washer 22 is provided within the hollow space 14 and abjacent the hand tools 30 by being extended through by the bolt 20 so as to tightly hold the hand tools 30 within the hollow space 14 of the handle 10.

The handle 10 also comprises a number of polygon holes 11 (see FIG. 4) formed on the bottom 15 thereof, serving as screw sockets of wrenches. Each of these polygon holes 11 has a different size so as to be fit for different-sized screws or bolts.

Figure 3:
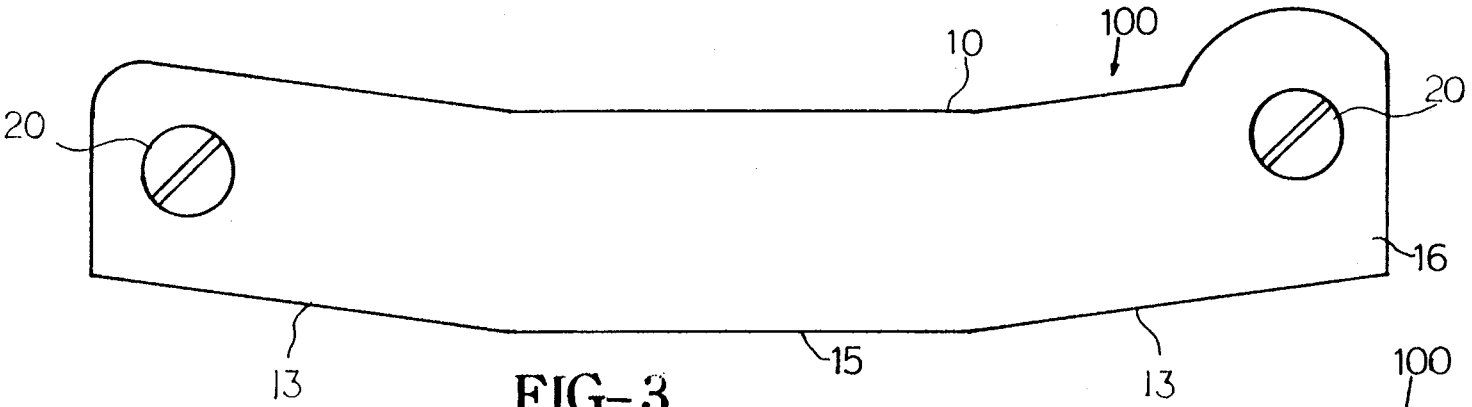
FIG. 3 is a side view of the hand tool set of the present invention.
Figure 4:
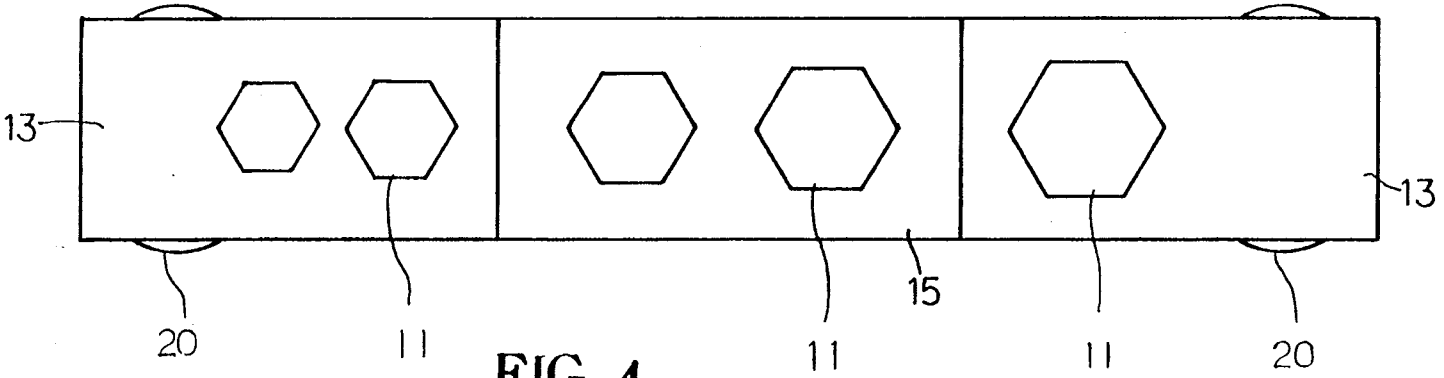
FIG. 4 is a bottom view of the hand tool set of the present invention.

To help rotating the handle 10 when it serves as a wrench as shown in FIG. 2, each of the ends of the handle 10 is provided with a slope 13 on the bottom 15, particularly see FIG. 3, so that when the handle 10 receives the head 42 of a bolt 41 which is tightened or to be tightened on a work piece 40 within one of the polygon holes 11, a gap A exists between the work piece 40 and the bottom 15 of the handle 10 to allow a user to hold the handle 10 with his or her hand 50 (FIG. 2) more easily.

It is apparent that althought the invention has been described in connection with the preferred embodiment, those skilled in the art may make changes to certain features of the preferred embodiment without departing from the spirit and scope of the invention as defined in the appended claims.

I claim:

1. A hand tool set comprising an elongated handle having a U-shaped cross section defined by a bottom and two side walls mounted to the bottom to provide a hollow space therebetween, said handle comprising two ends each having a pivot pin extending through the side walls thereof for rotatably supporting a number of hand tools thereon to allow the hand tools to be rotatable between a first position where the hand tools are completely received within the hollow space of said handle and a second position where working tips of the hand tools are exposed, and the improvement comprising a number of polygon holes formed on the bottom of said handle and a sloped section formed on the bottom at least one of the ends of said handle to provide a gap between the handle and a work piece worked upon by said hand tool set.

2. A hand tool set as claimed in claim 1 wherein the bottom of said handle has a sloped section formed at each of the ends of said handle.

3. A hand tool set as claimed in claim 1 wherein each of the pivot pins has an expanded head with serration formed thereon for more securely keeping the pivot pin and the hand tools supported thereby on said handle.

4. A handle tool set as claimed in claim 3 wherein said pivot pin comprises a bolt secured on said handle by a nut member.

5. A handle tool set as claimer in claim 1 wherein each of the pivot pins has a spring washer mounted thereon within the hollow space of said handle to provide a biasing force for tightly holding the hand tools in the first position within the hollow space of said handle.

* * * * *